US006619296B2

(12) United States Patent
Potut

(10) Patent No.: US 6,619,296 B2
(45) Date of Patent: Sep. 16, 2003

(54) HAIR GRIP WITH LIGHTER JAWS

(75) Inventor: Christian Potut, Arbent (FR)

(73) Assignee: C.S.P. Diffusion, Arbent (FR)

( * ) Notice: Subject to any disclaimer, the term of this patent is extended or adjusted under 35 U.S.C. 154(b) by 437 days.

(21) Appl. No.: 09/952,523

(22) Filed: Sep. 14, 2001

(65) Prior Publication Data

US 2002/0038660 A1 Apr. 4, 2002

(30) Foreign Application Priority Data

Sep. 26, 2000 (FR) ..... 00 12622

(51) Int. Cl.[7] ..... A45D 8/20; A45D 8/00
(52) U.S. Cl. ..... 132/277; 132/276
(58) Field of Search ..... 132/277, 276, 132/273, 135, 138, 279, 278

(56) References Cited

U.S. PATENT DOCUMENTS 1,819,667 A * 8/1931 Aaronson ..... 132/277
2,083,761 A * 6/1937 Tresenberg ..... 132/277
2,201,719 A 5/1940 Eicher
4,508,124 A * 4/1985 Franzino ..... 132/276
5,979,467 A * 11/1999 Potut et al. ..... 132/277
6,026,827 A * 2/2000 Revais ..... 132/277
6,189,544 B1 * 2/2001 Potut ..... 132/277

FOREIGN PATENT DOCUMENTS

| | | |
|---|---|---|
| DE | 27 48 601 A1 | 5/1979 |
| FR | 755 662 | 5/1933 |
| FR | 770 815 | 3/1934 |
| GB | 2 326 591 A | 12/1998 |

* cited by examiner

*Primary Examiner*—John J. Wilson
*Assistant Examiner*—Robyn Kieu Doan
(74) *Attorney, Agent, or Firm*—Ratner & Prestia

(57) ABSTRACT

A hair article according to the invention comprises two jaws which are elongate in a direction of extension and each include a rigid body having a principal part which is elongate in the direction of extension and parallel transverse excrescences to which is attached an elastically flexible structure parallel to the direction of extension, offset from the principal part of the rigid body and including projecting parts oriented toward the second jaw. A lighter hair article, in which the flexibility of the elastically flexible structure improves the hold in the hair, is thus produced.

10 Claims, 6 Drawing Sheets

HAIR GRIP WITH LIGHTER JAWS

TECHNICAL FIELD OF THE INVENTION

The present invention relates to articles for the hair in which a first jaw and a second jaw are opposite one another and articulated with respect to one another by articulation means in order to allow the clamping of a lock of hair.

Hair articles in the form of a grip, used for ladies' hair styling, have long been known. Such grips are described in particular in documents FR-A-770 805, FR-A-755 662, U.S. Pat. No. 2,201,719, DE-A-27 48 601 or GB-A-2 326 591.

Known hair grips generally comprise a first and a second jaw which are elongate in a direction of extension, opposite one another and articulated with respect to one another by articulation means allowing their respective pivoting about a lateral axis of articulation between an angularly separate position and a close position in which the two jaws are opposite one another in order to grip the lock of hair.

In these known hair-grip structures, each jaw is in one piece and includes a rigid body integral with at least one series of teeth which each extend directly from the rigid body. The teeth of a first jaw face toward the second jaw, in order to penetrate the hair engaged between the two jaws.

In other words, in known grip structures, the teeth and the principal body parts of each jaw form a rigid one-piece structure of relatively large mass.

In principle, hair articles have to offer effective gripping in the hair in order to prevent the displacement or fall of the hair article under the customary conditions of use. To this end, the jaws have to have a shape adapted to good gripping and to good attachment in the mass of hair.

Simultaneously, there is a need to reduce the production cost of such hair articles without thereby reducing their grip in the hair.

In point of fact, the grip of the hair article depends generally on the conditions of use and, in particular, on the variable number of hairs introduced between the jaws. Known hair-article structures do not allow sufficient adaptation to variations in conditions of use.

SUMMARY OF THE INVENTION

The problem proposed by the present invention is to design a new hair-article structure which makes it possible at one and the same time to improve the mechanical grip of the article in the hair and to lighten the jaws so as to reduce the quantity of materials thereof and thus the production cost.

To achieve these and other objectives, a hair article according to the invention comprises a first jaw and a second jaw which are elongate in a direction of extension, opposite one another and articulated to one another by articulation means allowing their respective pivoting about a lateral axis of articulation between an angularly separate position and a close position in which the two jaws are opposite one another, with two handling parts extending the respective jaws beyond the axis of articulation; furthermore, according to the invention, at least the first jaw comprises:

- a rigid body, having an elongate principal part extending in the direction of extension, and having parallel transverse excrescences;
- at least one elastically flexible structure extending in the direction of extension and offset laterally away from the principal part of the rigid body and connected just to the parallel transverse excrescences of the rigid body;
- the elastically flexible structure having projecting parts oriented toward the second jaw.

According to a first embodiment, in the close position of the two jaws, the transverse excrescences are in a plane generally parallel to the second jaw. In this case, the rigid body of the first jaw defines, by means of its elongate principle part and by means of its two transverse excrescences, a plane which is generally parallel and opposite to the second jaw, and the projecting parts of the elastically flexible structure extend in a direction which is generally perpendicular to the plane of the first jaw.

In an advantageous embodiment, the rigid body comprises only two end transverse excrescences to which the respective ends of the elastically flexible structure are secured.

In a first embodiment, constituting a hair grip, the lateral axis of articulation is arranged along the principal part of the rigid body, parallel to the direction of extension.

According to a second embodiment, constituting a hair article closer to a hair pin or hair slide, the lateral axis of articulation is arranged along an end excrescence of the rigid body, perpendicularly to the direction of extension.

In order to improve the grip in the hair, the said at least one jaw comprises two parallel elastically flexible structures which are offset laterally with respect to one another, parallel to the second jaw. The number of excrescences penetrating the hair is thus multiplied.

Advantageously, the two jaws may have similar structures, with a rigid body and elastically flexible structures.

In a first embodiment, the elastically flexible structure is a structure in the form of a rod curved into a series of adjacent arches extending over a surface substantially perpendicular to the other jaw, the linking feet of which constitute the projecting parts penetrating the hair.

The elastically flexible structure in the form of adjacent arches of a first jaw may advantageously overlap, in a close position, into an elastically flexible structure in the form of offset adjacent arches of the second jaw.

According to one possibility, the excrescences of a first jaw may extend perpendicularly to the plane of the second jaw.

According to an advantageous alternative, each jaw comprises:

- a first elastically flexible structure defining first projecting parts inclined toward a first direction of the direction of extension;
- a second elastically flexible structure defining second projecting parts inclined toward the second direction of the direction of extension.

It will be understood that this increases the stability of the hair article in the hair, owing to the inclination of the projecting parts in two opposite directions.

According to a preferred embodiment, the article for the hair also comprises elastic means stressing the jaws in rotation relative to one another, toward their close position.

As an alternative or as a supplement, it is possible to provide other means for securing the free ends of the two jaws together in the close position.

BRIEF DESCRIPTION OF THE DRAWINGS

Further objects, characteristics and advantages of the present invention will become apparent from the following description of particular embodiments which is given in connection with the attached figures, in which.

DESCRIPTION OF THE PREFERRED EMBODIMENTS

Figure 1:
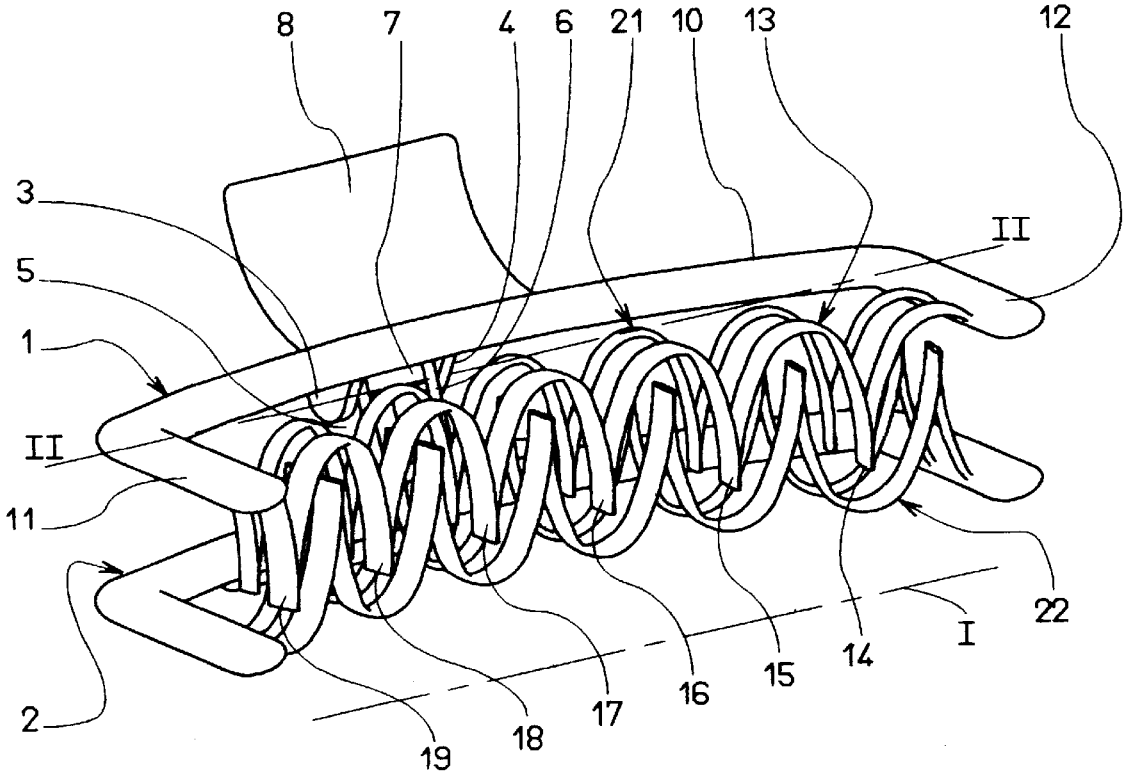
FIG. 1 is a perspective view of a hair article according to a first embodiment of the invention, in the closed position.
Figure 2:
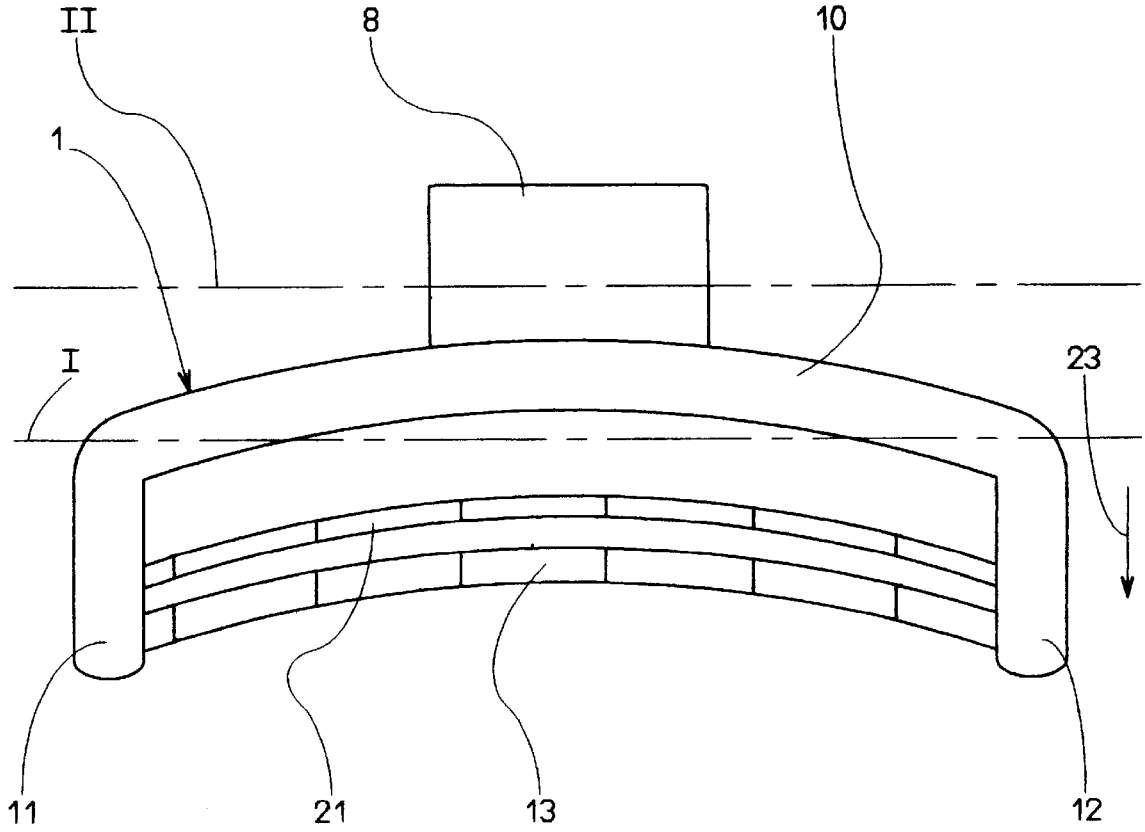
FIG. 2 is a top view of the hair article of FIG. 1.
Figure 3:
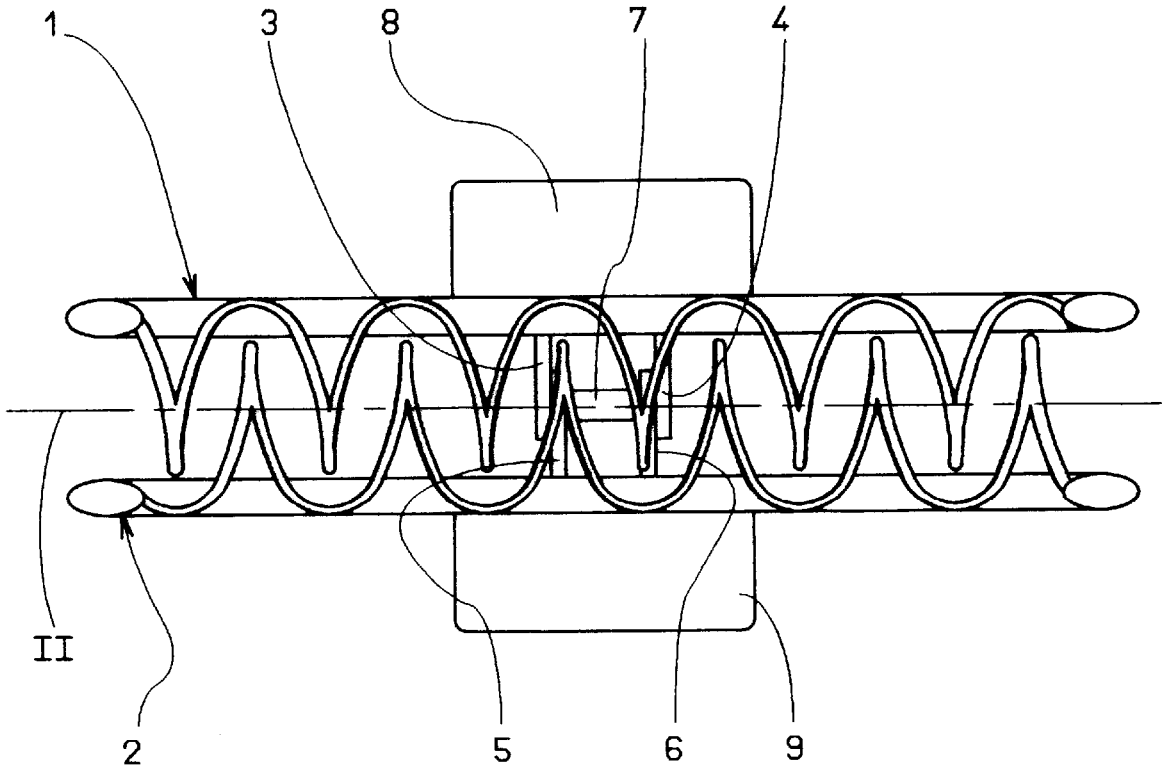
FIG. 3 is a front view of the hair article of FIG. 1.
Figure 4:
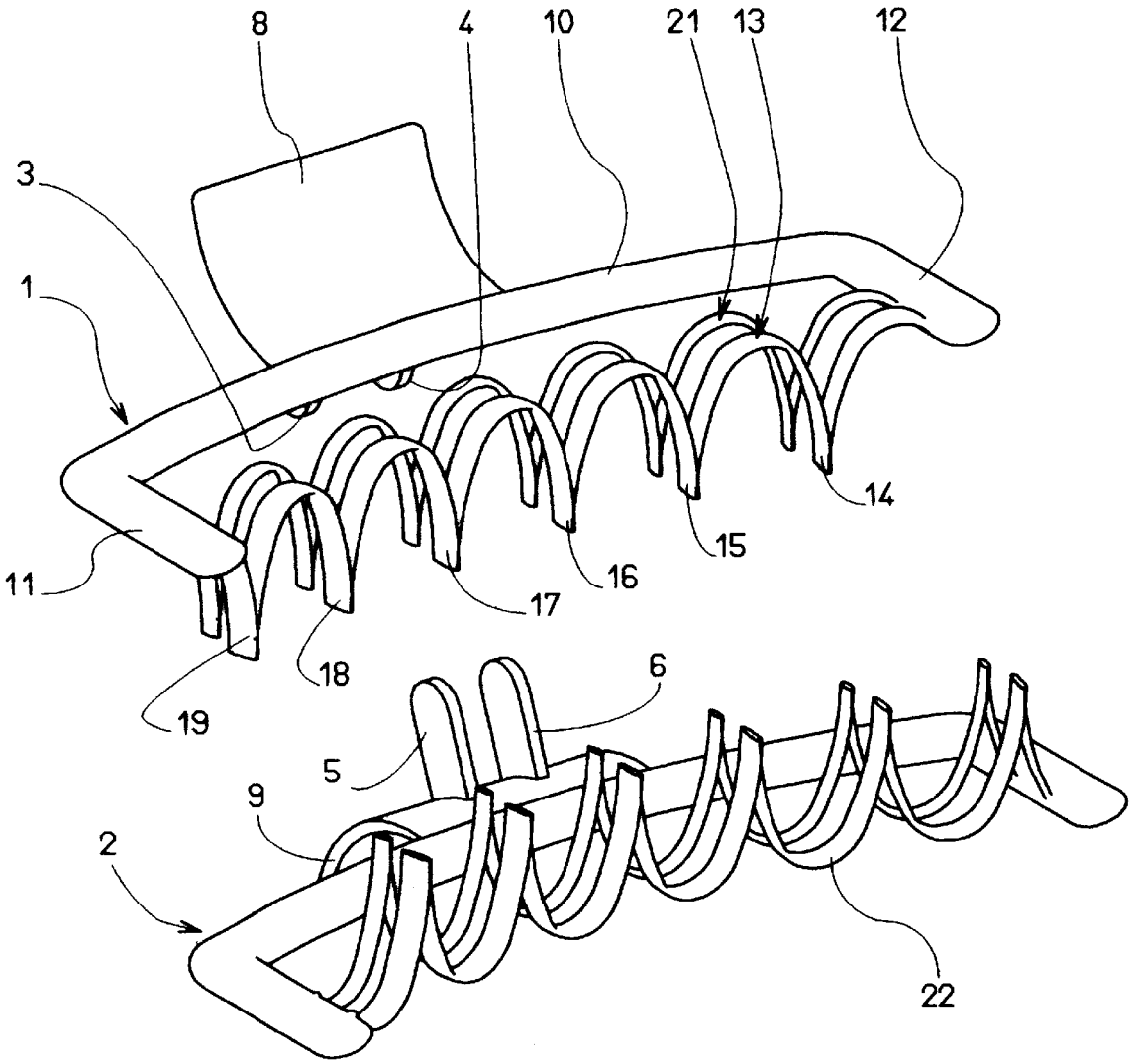
FIG. 4 is an expanded perspective view showing the two jaws of the hair article of FIG. 1 separated from one another.
Figure 5:
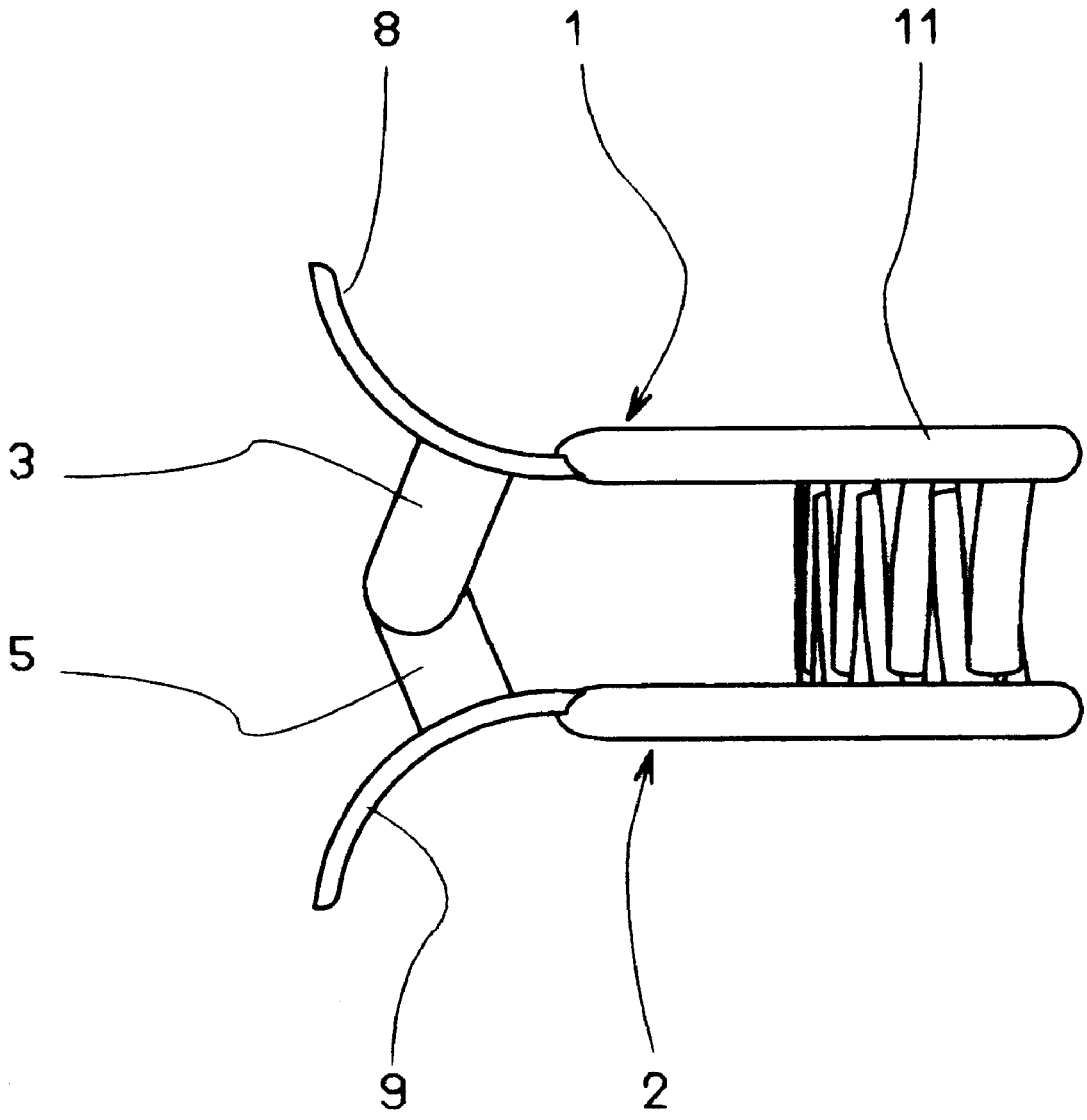
FIG. 5 is a side view of the hair article of FIG. 1.

In the embodiment illustrated in FIGS. 1 to 5, a hair article according to the invention comprises a first jaw I and a second jaw 2, both of which are elongate in a direction of extension I, opposite one another and articulated with respect to one another by articulation means allowing their respective pivoting about a lateral axis of articulation II—II between an angularly separate position and a close position, as illustrated in FIGS. 1 to 3.

For example, as illustrated in the figures, the articulation means comprise, on the first jaw 1, two first perforated studs 3 and 4 which are parallel and spaced from one another over a stabilization distance. The articulation means comprise, on the second jaw 2, two second perforated studs 5 and 6 which are parallel and spaced from one another over a suitable distance for them to engage on either side of the first perforated studs 3 and 4. A linking pin 7, oriented along the axis of articulation II—II, traverses the four perforated studs in order to connect the jaws 1 and 2 while still allowing their relative pivoting.

Two handling parts 8 and 9 extend the respective jaws 1 and 2 beyond the axis of articulation II—II.

In the embodiment illustrated in FIGS. 1 to 4, the two jaws 1 and 2 have the same structure and the first jaw 1 will be described primarily.

The first jaw 1 comprises a rigid body which is integral with the handling part 8 and has an elongate principal part 10 in the form of a flattened bar extending in the direction of extension I and having transverse excrescences 11 and 12 which are parallel to one another. In the embodiment illustrated, the transverse excrescences 11 and 12 are two in number and form two end transverse excrescences connected to the corresponding ends of the principal part 10.

In the embodiment illustrated in the figures, in the close position of the two jaws 1 and 2, the transverse excrescences 11 and 12 are in a plane generally parallel to the second jaw 2, i.e. extending in a direction generally perpendicular to the plane containing the two principal parts 10 of the two jaws 1 and 2.

The first jaw 1 also comprises at least one first elastically flexible structure 13 which extends in the direction of extension I, away from the principal part 10 of the rigid body, and which is connected to just the parallel transverse excrescences 11 and 12 of the rigid body. The first elastically flexible structure 13 includes projecting parts 14, 15, 16, 17, 18 and 19 oriented toward the second jaw 2.

In the embodiment illustrated, the first jaw 1 comprises two elastically flexible structures 13 and 21, for example of the same form, which are parallel and offset laterally from one another, parallel to the second jaw 2.

The first elastically flexible structure 13 is a structure in the form of a rod curved into a series of adjacent arches extending over a surface perpendicular to the second jaw 2, the linking feet of which constitute the said projecting parts 14–19.

In the embodiment illustrated in the figures, the two jaws 1 and 2 have similar structures, with a rigid body and elastically flexible structures. An elastically flexible structure 22 of the second jaw 2 corresponds to each elastically flexible structure such as the elastically flexible structure 13 of the first jaw 1. In the close position of the two jaws 1 and 2, the first elastically flexible structure 13 in the form of adjacent arches of the first jaw 1 overlaps into the elastically flexible structure 22 in the form of offset adjacent arches of the second jaw 2. In other words, the projecting parts 14–19 of the first elastically flexible structure 13 engage in the concave parts of the arches of the elastically flexible structure 22 of the second jaw 2.

As may be seen clearly in the figures, particularly FIG. 2, each of the elastically flexible structures 13 and 21 of the first jaw 1 is offset laterally, in the direction 23, relative to the principal part 10 of the first jaw 1. The result of this is a particularly light structure of the first jaw 1 and an elastic deformation capability of the part including the projecting parts 14–19.

As may be seen in the figures, particularly FIG. 2, the elastically flexible structure 13 extends over a surface substantially perpendicular to the other jaw 2. This surface may be planar, the elastically flexible structures then being rectilinear when seen from above. However, in the embodiment of FIG. 2, the surface over which the elastically flexible structures 13 and 21 extend may be advantageously curved, in order better to follow the rounded shape of a user's head.

In the embodiment illustrated in FIGS. 1 to 5, the projecting parts 14–19 extend in a direction substantially perpendicular to the second jaw 2.

Figure 6:
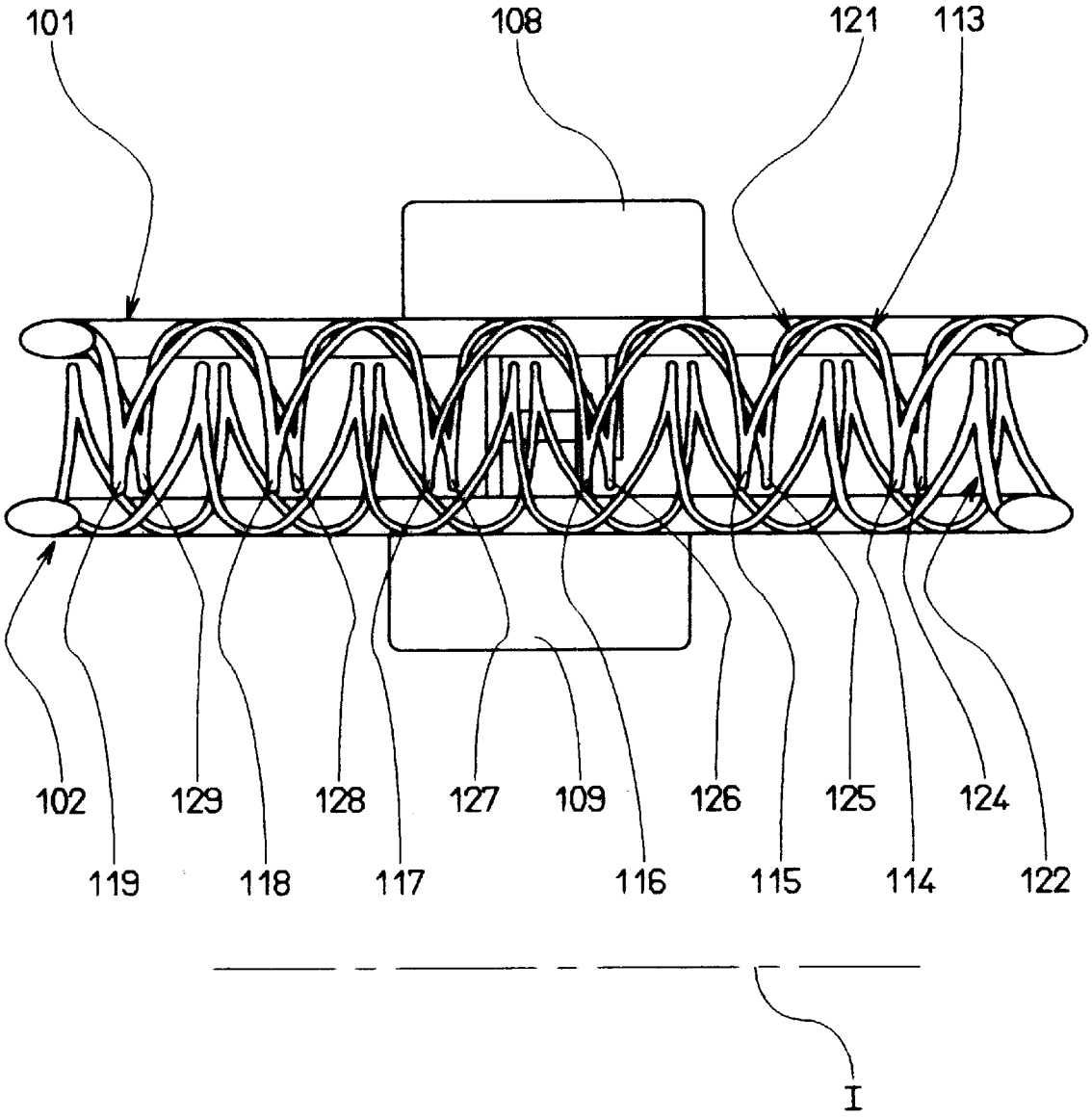
FIG. 6 is a front view of a hair article according to a second embodiment of the invention.

As an alternative, as illustrated in the embodiment of FIG. 6, provision may advantageously be made for each jaw 101 and 102 to comprise a first elastically flexible structure 113 defining first projecting parts 114–119 which are inclined toward a first direction of the direction of extension I, i.e. toward the left in FIG. 6, while a second elastically flexible structure 121 on the same first jaw 101 defines second projecting parts 124–129 which are inclined toward the second, opposite direction of the direction of extension I, i.e. toward the right in FIG. 6. The grip of the article in the hair is thus improved. This FIG. 6 also distinguishes the handling parts 108 and 109 and also the first elastically flexible structure 122 of the second jaw 102.

The handling parts 8 and 9 or 108 and 109 may have various forms. In FIGS. 1 to 6, a rectangular shape has, for example, been illustrated. Other forms may be chosen without this modifying the technical effect of the invention which results from the elastically flexible structure constituting the projecting parts which are intended to penetrate the hair.

Various forms of projecting part are possible. In the figures, projecting parts in the form of teeth have been shown. However, projecting parts which undulate, creating waves in the hair, may be chosen.

In the embodiments illustrated in the figures, which constitute front hair grips, the lateral axis of articulation II—II is arranged along the principal part 10 of the rigid body of first jaw 1, parallel to the direction of extension I.

As an alternative, the lateral axis of articulation II—II may be arranged along an end transverse excrescence 11 or 12 of the rigid body, perpendicularly to the direction of extension I. The hair article then constitutes a side hair grip.

In all the embodiments, provision may advantageously be made for elastic means stressing the jaws 1 and 2 in rotation with respect to one another, toward their close position. In this way, the elastic means determine and maintain the pressure of the jaws 1 and 2 on either side of a lock of hair when the article for the hair is in place in a user's hair. The elastic means may be of any known type used in hair grips and, for example, a helical spring engaged about the pin 7.

The present invention is not limited to the embodiments which have been expressly described, but it includes the various alternative embodiments and generalizations thereof which are included in the scope of the following claims.

What is claimed is:

1. A hair article comprising a first jaw and a second jaw which are elongate in a direction of extension, opposite one another and articulated to one another by articulation means allowing their respective pivoting about a lateral axis of articulation between an angularly separate position and a close position in which the two jaws are opposite one another, with two handling parts extending the respective jaws beyond the axis of articulation, wherein at least the first jaw comprises:

a rigid body, having an elongate principal part extending in the direction of extension, and having parallel transverse excrescences;

at least one elastically flexible structure extending in the direction of extension and offset laterally away from the principal part of the rigid body and connected just to the parallel transverse excrescences of the rigid body;

the elastically flexible structure having projecting parts oriented toward the second jaw.

2. The hair article according to claim 1, wherein, in the close position of the two jaws, the transverse excrescences are in a plane generally parallel to the second jaw.

3. The hair article according to claim 1, wherein the rigid body comprises only two end transverse excrescences to which the respective ends of the elastically flexible structure are secured.

4. The hair article according to claim 1, wherein the lateral axis of articulation is arranged along the principal part of the rigid body, parallel to the direction of extension.

5. The hair article according to claim 1, wherein the lateral axis of articulation is arranged along an end transverse excrescence of the rigid body, perpendicularly to the direction of extension.

6. The hair article according to claim 1, wherein the said first jaw at least comprises two parallel elastically flexible structures which are offset laterally with respect to one another, parallel to the second jaw.

7. The hair article according to claim 1, wherein the two jaws have similar structures, with a rigid body and elastically flexible structures.

8. The hair article according to claim 1, wherein the elastically flexible structure is a structure in the form of a rod curved into a series of adjacent arches extending over a surface perpendicular to the other jaw, the linking feet of which constitute the said projecting parts.

9. The hair article according to claim 8, wherein the elastically flexible structure in the form of adjacent arches of a first jaw overlaps, in a close position, into an elastically flexible structure in the form of offset adjacent arches of the second jaw.

10. The hair article according to claim 1, wherein each jaw comprises:

a first elastically flexible structure defining first projecting parts inclined toward a first direction of the direction of extension a second elastically flexible structure defining second projecting parts inclined toward the second direction of the direction of extension.

* * * * *